US008701567B1

(12) United States Patent
Esfandiari et al.

(10) Patent No.: US 8,701,567 B1
(45) Date of Patent: Apr. 22, 2014

(54) PORTABLE EXERCISE WORKSTATION

(75) Inventors: Tony Esfandiari, Woodland Hills, CA (US); Paige Esfandiari, Woodland Hills, CA (US); Gerald Henning, Nunica, MI (US); Gregory J. Parker, Nunica, MI (US)

(73) Assignee: Global Marketing Partners, Inc., Woodland Hills, CA (US)

( * ) Notice: Subject to any disclaimer, the term of this patent is extended or adjusted under 35 U.S.C. 154(b) by 0 days.

(21) Appl. No.: 12/877,762

(22) Filed: Sep. 8, 2010

Related U.S. Application Data

(60) Provisional application No. 61/240,496, filed on Sep. 8, 2009.

(51) Int. Cl.
*A47B 23/00* (2006.01)
*A47B 23/04* (2006.01)

(52) U.S. Cl.
CPC ..... *A47B 23/04* (2013.01)
USPC ..... 108/42

(58) Field of Classification Search
USPC ..... 108/42, 44, 49, 43, 152, 50.01, 162, 91, 108/92, 93; 248/444, 444.1, 448, 449, 443; 482/54, 52, 148
See application file for complete search history.

(56) References Cited

U.S. PATENT DOCUMENTS

| | | | | |
|---|---|---|---|---|
| 3,034,841 | A * | 5/1962 | Blevins | 108/92 |
| 4,760,800 | A * | 8/1988 | Hanson | 108/42 |
| 4,790,506 | A * | 12/1988 | Malinowski et al. | 248/441.1 |
| 5,038,688 | A * | 8/1991 | Permenter | 108/43 |
| 5,085,427 | A * | 2/1992 | Finn | 248/441.1 |
| 5,331,904 | A * | 7/1994 | DiSimone et al. | 108/44 |
| 5,443,019 | A * | 8/1995 | Sheldrick | 108/44 |
| 6,224,516 | B1 | 5/2001 | Disch | |
| 6,652,425 | B1 * | 11/2003 | Martin et al. | 482/57 |
| 6,808,475 | B2 | 10/2004 | Kehrbaum | |
| 6,908,414 | B1 * | 6/2005 | Roadman | 482/51 |
| 7,335,147 | B2 | 2/2008 | Jones et al. | |
| 7,887,021 | B2 * | 2/2011 | Shevin-Sandy | 108/42 |
| 8,104,411 | B2 * | 1/2012 | Fenton | 108/42 |
| 2003/0075083 | A1 * | 4/2003 | Devey | 108/92 |
| 2004/0094677 | A1 * | 5/2004 | Guo et al. | 248/205.2 |
| 2006/0191449 | A1 * | 8/2006 | Patten | 108/92 |
| 2006/0247109 | A1 | 11/2006 | Powell | |
| 2006/0258513 | A1 | 11/2006 | Routley et al. | |
| 2008/0314851 | A1 | 12/2008 | Jacoby | |

* cited by examiner

*Primary Examiner* — Jose V Chen
(74) *Attorney, Agent, or Firm* — The Eclipse Group LLP

(57) ABSTRACT

A portable workstation is provided that includes a lower work surface and an upper work surface, where the upper work surface is supported by at least one support member that maintains the upper work surface and the lower work surface in a tiered, spaced apart relationship with one another. The portable workstation includes at least one pair of fastening members positioned on the underside of the lower work surface for securing the workstation across horizontal stabilizing bars of an exercise machine. The mounting members may be adjustable straps, such as Velcro® strap, for removeably coupling the workstation to the exercise machine.

5 Claims, 18 Drawing Sheets

PORTABLE EXERCISE WORKSTATION

RELATED APPLICATIONS

This application claims priority to U.S. Provisional Patent Application Ser. No. 61/240,496, filed on Sep. 8, 2009, titled PORTABLE EXERCISE WORKSTATION, which application is incorporated in its entirety by reference in this application.

BACKGROUND OF THE INVENTION

1. Field of the Invention

The invention relates generally to a portable desktop apparatus, and more particularly to a portable workstation that can be mounted onto modern exercise equipment.

2. Related Art

Most modern exercise equipment such as treadmills, include fixtures that enable the user to place a book or magazine in an upright or angled position so the user can read while exercising. While such fixtures provide the user with the ability to read while exercising, they lack the capacity to support other forms of work-related activity, such as working with a computer or writing. To provide a more useful work surface, others have developed various attachments for exercise equipment that enable users to fasten more workable surfaces to exercise equipment, but such attachments are bulky, obtrusive, and often obstruct the user's view of the exercise equipment control panel. Others have built workstations around exercise equipment, typically treadmills, that allow the user to conduct a number of tasks while walking, but these workstations are not sturdy and they require extensive effort to set up and breakdown.

Thus, a need exists for a sturdy, non-obstructive portable workstation capable of accommodating a variety of work-related activities.

SUMMARY

A portable workstation is provided that includes a lower work surface and an upper work surface, where the upper work surface is supported by at least one support member mounted on the lower work surface. The at least one support member maintains the upper work surface and the lower work surface in a tiered, spaced apart relationship with one another. The portable workstation includes at least one pair of fastening members positioned on the underside of the lower work surface for securing the workstation across horizontal stabilizing bars of an exercise machine. The mounting members may be adjustable straps, such as Velcro® straps, for removeably coupling the workstation to the exercise machine. Further, the fastening members may be secured to the lower work surface along adjustable plates that allow the distance between the at least one pair of fastening members to vary position along the width of the workstation.

In one example of another implementation, the workstation includes only a lower work surface with at least one pair of fastening members positioned on the underside of the lower work surface. The mounting members may again be adjustable straps, such as fabric, plastic or Velcro® straps, for removeably coupling the workstation to the horizontal stabilizing bars of an exercise machine.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

As illustrated in the attached FIGS. 1-25, a sturdy, portable workstation 100 is provided that includes a lower (or primary) work surface 102 spaced apart from an upper (or secondary) work surface 104. As will be further illustrated below, the lower or primary work surface 102 may be removably mounted on horizontal support bars (not shown) of an exercise machine, such as a treadmill.

Although not illustrated, those skilled in the art will recognize that the workstation 100 may, optionally, include a media module that includes power inputs, USB inputs, VGA monitor inputs, and a telephone jack to help organize and facilitate the use of the workstation 100 in an office environment. Further, although the workstation 100 illustrated in FIGS. 1-25 includes both a lower work surface 102 and an upper work surface 104, the workstation 100 may be designed to include only a primary or lower work surface 102, which design is considered within the scope of the invention.

Figure 1:
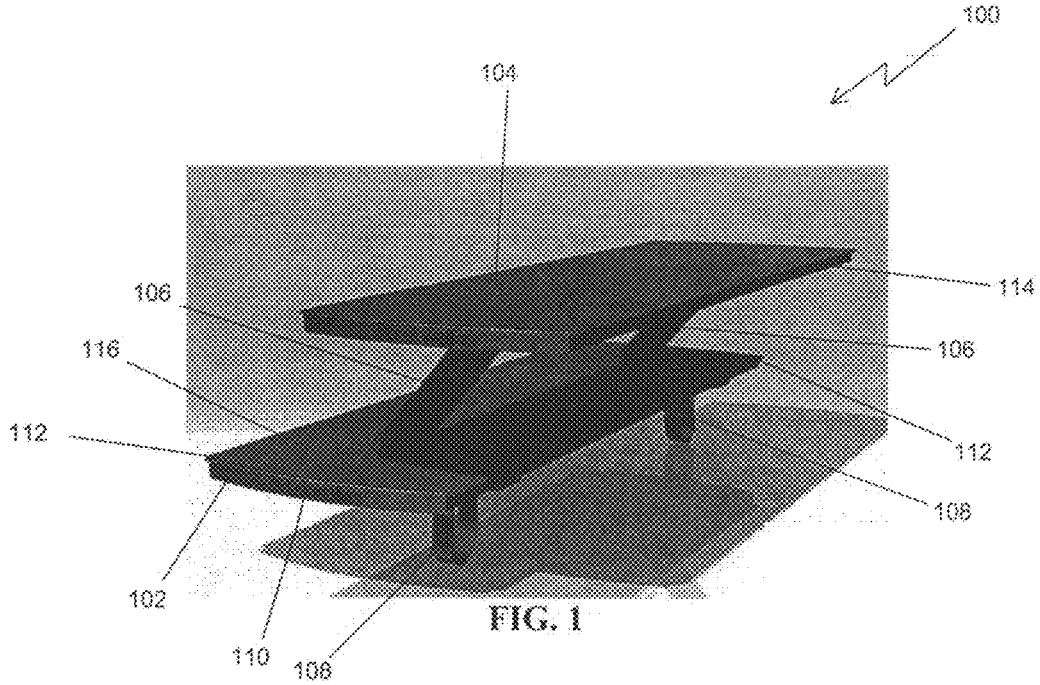
FIG. 1 illustrates a rear perspective view of one example of a design of a portable workstation of the present invention.

FIG. 1 illustrates a rear perspective view of one example of a design of a portable workstation 100 of the present invention. As shown, the workstation 100 includes a lower work surface 102, an upper work surface 104, and a pair of support members 106 attached to the underside 114 of the upper work surface 104 and the top side 116 of the lower work surface 102. The support members 106 further maintain the lower work surface 102 and the upper work surface 104 in spaced apart relation. The lower work surface 102, the upper work surface 104, and the support members 106 may generally be constructed from the same material. For example, the lower work surface 102, upper work surface 104, and support members 106 may each be constructed of plastic, fiberglass, composites, metal, wood, or any other suitable material. In the implementation of the invention illustrated in FIGS. 1-25, the lower work surface 102, upper work surface 104, and support members 106 are each constructed of aluminum alloy. Alternatively, the lower work surface 102, upper work surface 104, and support members 106 may each be constructed from different material or, the lower and upper work surfaces 102, 104 may be constructed from one material, such as aluminum, while the support members 106 may be made of another material, such as plastic, for example.

Also as shown in FIG. 1, the workstation 100 further includes fastening members 108 for fastening the workstation 100 to the horizontal stabilizing bars of an exercise machine. As will be explained further below, the fastening member 108 may take the form of bracket or adjustable straps, including, but not limited to metal brackets, plastic straps or fabric straps, such as adjustable Velcro® straps, that are capable of fastening onto the horizontal stabilizing bars of an exercise machine (i.e. the horizontal bars provided to help stabilizing the user when on the machine). The workstation 100, as illustrated in FIG. 1, includes two opposing fastening members 108 positioned on the underside 110 of the lower work surface 102 near the opposing side ends 112 of the lower work surface 102. Although the illustrated example in FIGS. 1-22 show two fastening members 108 on each side 112 of on the underside 110 of the lower work surface 102, as illustrated and explained further below, one or more fastening members 108 may be positioned at varying positions along the underside 110 of the lower work surface 102.

Figure 2:
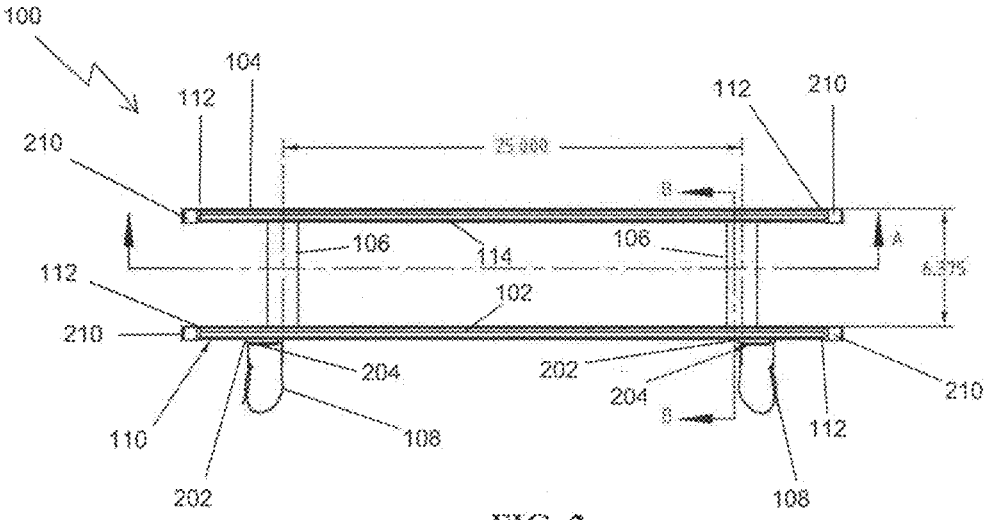
FIG. 2 is a front elevation view of the portable workstation of FIG. 1.

FIG. 2 is a front elevation view of the portable workstation 100 of FIG. 1. As illustrated, the upper work surface 104 is supported above the lower work surface 102 via the support members 106. In this view, it can be seen that the fastening members 108 are held on the underside of the lower work surface by adjustment plates 202, which include a protective strip 204 positioned below the adjustment plates 202. The fastening members 108 may be secured directly to the adjustment plates 202 by an adhesive or fastener or, may be looped around the adjustment plates 202 by feeding the fastening member 108 through the space formed between the adjustment plates 202 and the underside 110 of the lower work surface 102. For purposes of this application, the fastening members 108 shall be considered secured to the adjustment plates 202 whether fastened, adhered or looped around the adjustment plates 202.

The protective strips 204 form the contact surface between the portable workstation 100 and the horizontal stabilizing bars of the exercise machine. The protective strips 204 may, for example, be made of a rubber or plastic material to provide cushioning and protect the stabilizing bars against damage through contact with the portable workstation. The protective strips 204 may also help stabilized the portable workstation on the exercise machine by providing slide resistant contact with the exercise machine.

The protective strips 204 may be secured to the underside of the adjustment plates 202 by any known fastening mechanisms suitable for maintain the protective strips 204 against the underside of the adjustment plates 202 to create a protective contact surface. Such fastening mechanism may, for example, be an adhesive.

Also illustrated in FIG. 2 are protective end caps 210 positioned on the side ends 112 of the lower and upper work surfaces 102, 104, as will be further described below. Further, while the view in FIG. 2 shows two support members 106, a single support member 106 or multiple support members may be used to support the upper work surface 104.

Figure 3:
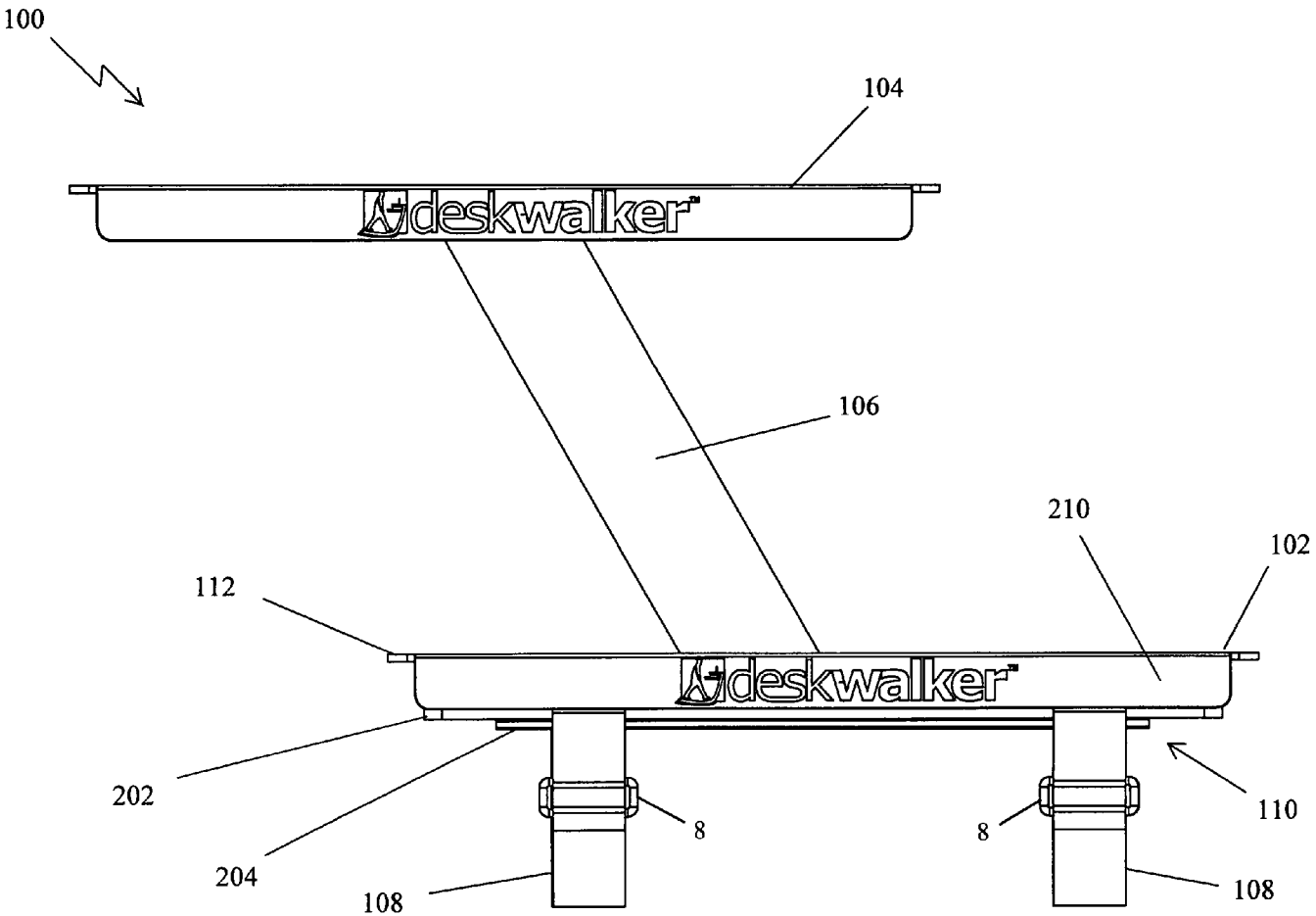
FIG. 3 is a side view of the portable workstation of FIG. 1 illustrating two fastening members on the underside of each exterior side of the portable workstation.

FIG. 3 illustrates a side view of the portable workstation of FIG. 1; however, FIG. 3 illustrates two fastening members 108 having tightening mechanism 8 for reducing the size of the opening of the fastening member 108 positioned on the underside 110 of each side end 112 of the lower work surface 102 of the portable workstation 100 for securing the fastening member to the stabilizing bar of the exercise machine. In this view, the spatial relationship between the lower work surface 102 and upper work surface 104 separated and supported by the support members 106 is further shown. FIG. 3 also illustrates the attachment of the fastening members 108 to the underside 110 of the lower work surface 102 by adjustment plates 202. As described above, a protective strip 204 may be attached to each adjustment plate 202 to protect and help stabilize the workstation 100 to the exercise machine.

Figure 4:
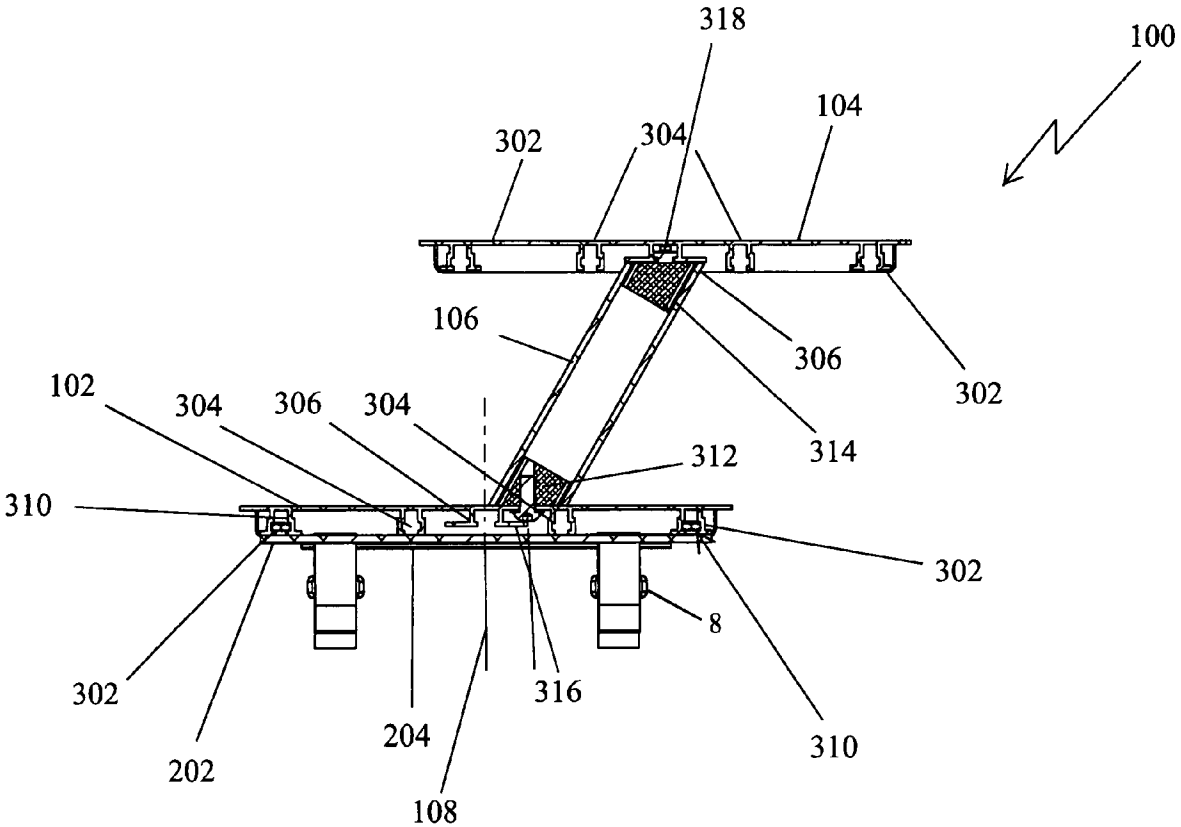
FIG. 4 is a cross-section view of the portable workstation of FIG. 1 taken along section line B-B of FIG. 2.

FIG. 4 is a cross-section view of the portable workstation of FIG. 1 taken along section line B-B of FIG. 2. In addition to illustrating the upper work surface 104, lower work surface 102, support members 106 and fastening members 108 having tightening means 8, FIG. 4 illustrates the basic manner in which the members are interconnected or secured to one another. In particular, the underside 110, 114 of both the lower and upper work surfaces 102, 104 respectively, each include a pair of external channels 302, a pair of interior channels 304, and a center channel 306. In the provided example, the adjustment plates 202 are secured to the underside 110 of the lower work surface 102 via the exterior channels 302 through plate fastening mechanisms 310.

Turning now to the region between the lower and upper work surfaces 102, 104, the support members 106 are hollowed bodied members that each includes a lower fastening plug 312 and an upper fastening plug 314 in the opposing ends of the support members. The lower fastening plug 312 secures the support members 106 against the top surface 116 of the lower work surface 102 through a lower support fastening member 316. The upper fastening plugs 314 secures the support members 106 to the center channel 306 of the underside 114 of the upper work surface 104 through upper support fastening members 318. In the provided example, the interior channels 304 provided on the undersides 110, 114 of the lower and upper work surfaces 102, 104 respectively, are optional, and are provided in the illustrated example to increase the rigidity and strength of the lower and upper work surfaces 102, 104, respectively.

Figure 5:
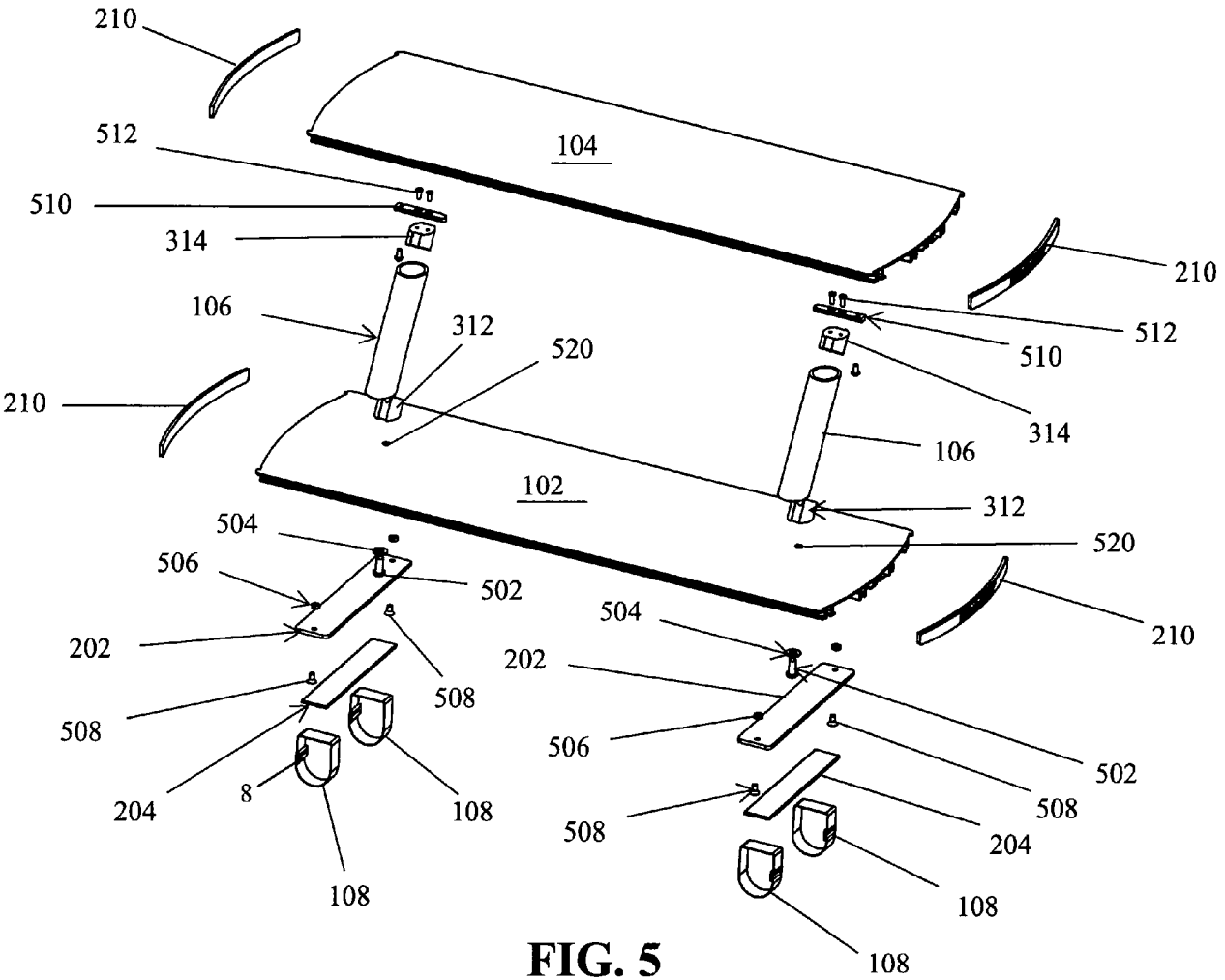
FIG. 5 is an exploded view of the portable workstation of FIG. 1.

FIG. 5 is an exploded view of the portable workstation of FIG. 1. FIG. 5 illustrates the detailed attachment of the lower work surface 102, upper work surface 104, support members 106 and fastening members 108 having tightening means 8. As shown in FIGS. 4 & 5, the adjustment plates 202 may be secured to the underside 110 of the lower work surface 102 by the plate fastening mechanisms 310 (FIG. 4). The support members 106 may be secured to top surface 116 of lower work surface 102 by the lower support fastening members 316 (FIG. 4), and the support members 106 may be secured to the underside 114 of the upper work surface 104 by the upper support fastening members 318 (FIG. 4). FIG. 5 illustrates, as further detailed below, the elements that comprise, in the illustrated example, the plate fastening mechanism 310, the lower support fastening members 316 and the upper support fastening members 318.

The plate fastening mechanisms 310 may include a nut fastener 506 and a threaded fastener 508. The nut fastener 506 may include any standard nut fastener, for example, a ¼"-hex jam nut. The threaded fastener 508 may include any standard threaded fastener, for example, a ¼"-20×½" FHSC screw. As explained in further detail below, the plate fastening mechanisms 310 secure the adjustment plates 202 to the external channels 302 along the underside 110 of the lower work surface 102. These adjustment plates 202 are secured to the external channels 302 by threaded fasteners 508 that engage countersunk holes located at each end of the adjustment plate. The threaded fasteners 508 are fastened by engaging the nut fasteners 506, which are retained in the external channels 302. The relative positions of the adjustment plates 202 along the external channels 302 may be adjusted by loosening the engagement of the threaded fastener 508 from the nut fastener 506.

Alternatively, although not shown, the adjustable brackets 202 or fastening members 108 may be secured directly to the underside 110 of the lower work surface 102 through known fastening means, in additional to the channel fastening means described above. The lower work surface 102 can be further designed to allow the adjustable brackets 202 or fastening members 108 to be fastened at various positions on the underside 110 of the lower work surface 102 to vary the spacing or distance between the fastening members 108.

The lower support fastening members 316 may include a threaded fastener 502 and a washer 504. The threaded fastener 502 may include any standard threaded fastener, for example, a ⅜"-24×⅞" BHS screw. The washer 504 may include any standard washer, for example, a ⅜" flat SAE washer. As explained in further detail below, the lower support fastening members 316 secure the lower work surface 102 to the lower fastening plugs 312 by the threaded fasteners 502 that engage thru holes 520 (FIG. 6) of the lower work surface 102. The threaded fasteners 502 are fastened by engaging mating threaded holes carried by the lower fastening plugs 312. The washers 504 may rest between the underside 110 of the lower work surface 102 and the head of the threaded fastener 502 to provide a load bearing surface for the screw.

The upper support fastening members 318 may include a slidable T-nut fastener 510 and pair of threaded fasteners 512. The T-nut fastener 510 may be a slender elongated member having a pair of threaded countersunk holes. The body of the T-nut fastener 510 is configured to be slidably confined within the center channel 306 of the upper work surface 104.

The threaded fasteners 512 may include any standard nut fastener, for example, #10-24×½" BHSC screws. As explained in further detail below, the upper support fastening members 318 secure the upper fastening plugs 314 to the center channel 306 along the underside 114 of the upper work surface 104. The upper fastening plugs 314 are secured to the center channel 306 by the threaded fasteners 512, which engage the countersunk holes of the T-nut fasteners 510. The threaded fasteners 512 are fastened by engaging a mating pair of threaded holes carried by the upper fastening plugs 314.

While a T-nut fastener is described above, persons skilled in the art will appreciate that the upper fastening plugs 314 may be secured to the underside 114 of the upper work surface 104 by other suitable means.

Figure 6:
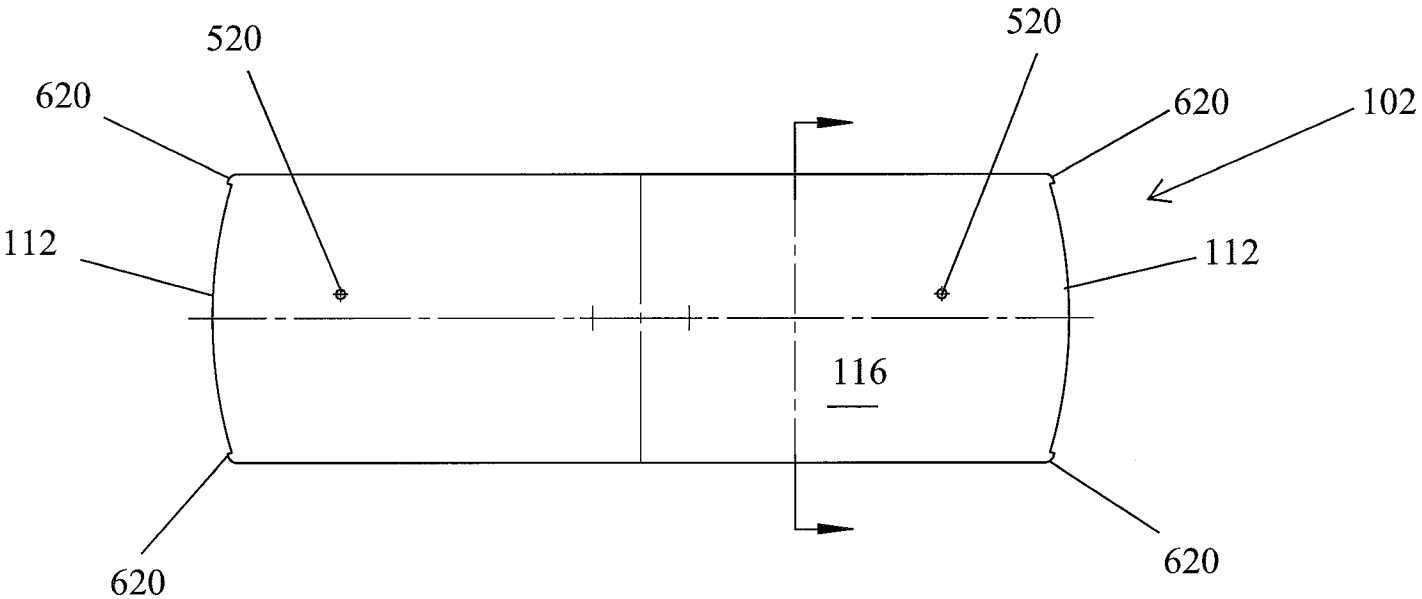
FIG. 6 is a plan view of the lower work surface of the portable workstation of FIG. 1.

FIG. 6 is a plan view of the lower work surface 102 of the portable workstation 100. As shown in FIG. 6, the lower work surface 102 may be a planar generally rectangular member having a top "working" surface 116, an underside 110, and opposing side ends 112. In this example, the lower work surface 102 has dimensions of approximately 12 inches wide by 36 inches long. In other implementations, the lower work surface 102 may be an arcuate member, a spline-shaped member, or may comprise any other suitable shape or dimensions. Further, since a user may come in unwanted contact with the workstation 100 while exercising, the corners 620 of both the lower and upper work surfaces 102, 104 may be designed to be round or covered with plastic or other protective material to avoid harm to a user upon contact.

As illustrated, the lower work surface 102 includes at least one pair of thru holes 520 that extend from the top surface 116 through to the underside 110 of the lower work surface 102. These thru holes 520 are provided for the purpose of securing a respective support member 106 to the top surface 116 of the lower work surface 102. The thru holes 520 may be spaced apart at a predetermined distance and disposed along an aft region of the top surface 116. Persons of ordinary skill in the art will appreciate that slots, instead of thru holes 520, may be used to secure the support members 106 to the top surface 116 of the lower work surface 102 to enable the user to adjust the distance between the support members 106. This feature allows the user to couple together lower and upper work surfaces 102, 104 of different dimensions.

Figure 7:
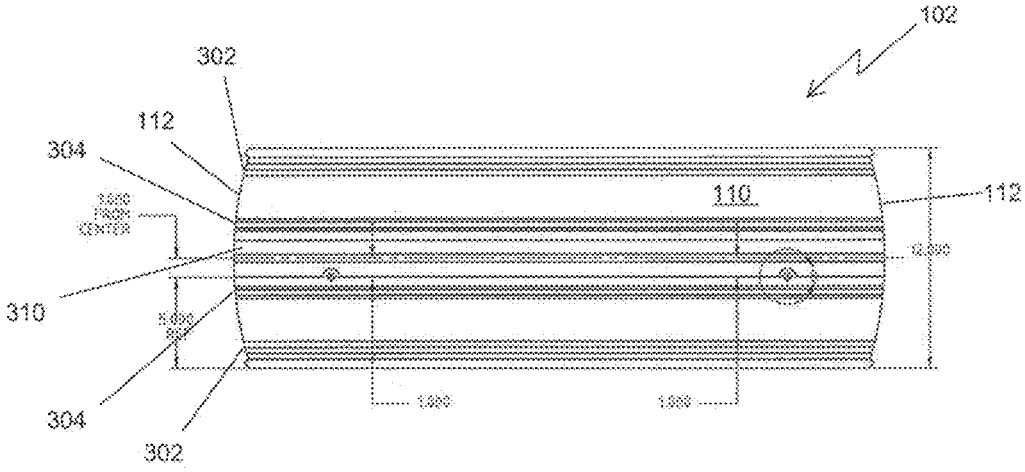
FIG. 7 is a bottom view of the lower work surface of FIG. 6.

FIG. 7 is a bottom view of the lower work surface 102 of the portable workstation 100. As shown, the external, interior, and center channels 302, 304, 306 are generally spaced-apart parallel channels extending substantially along the entire length of the lower work surface 102 between opposing side ends 112.

Figure 8:
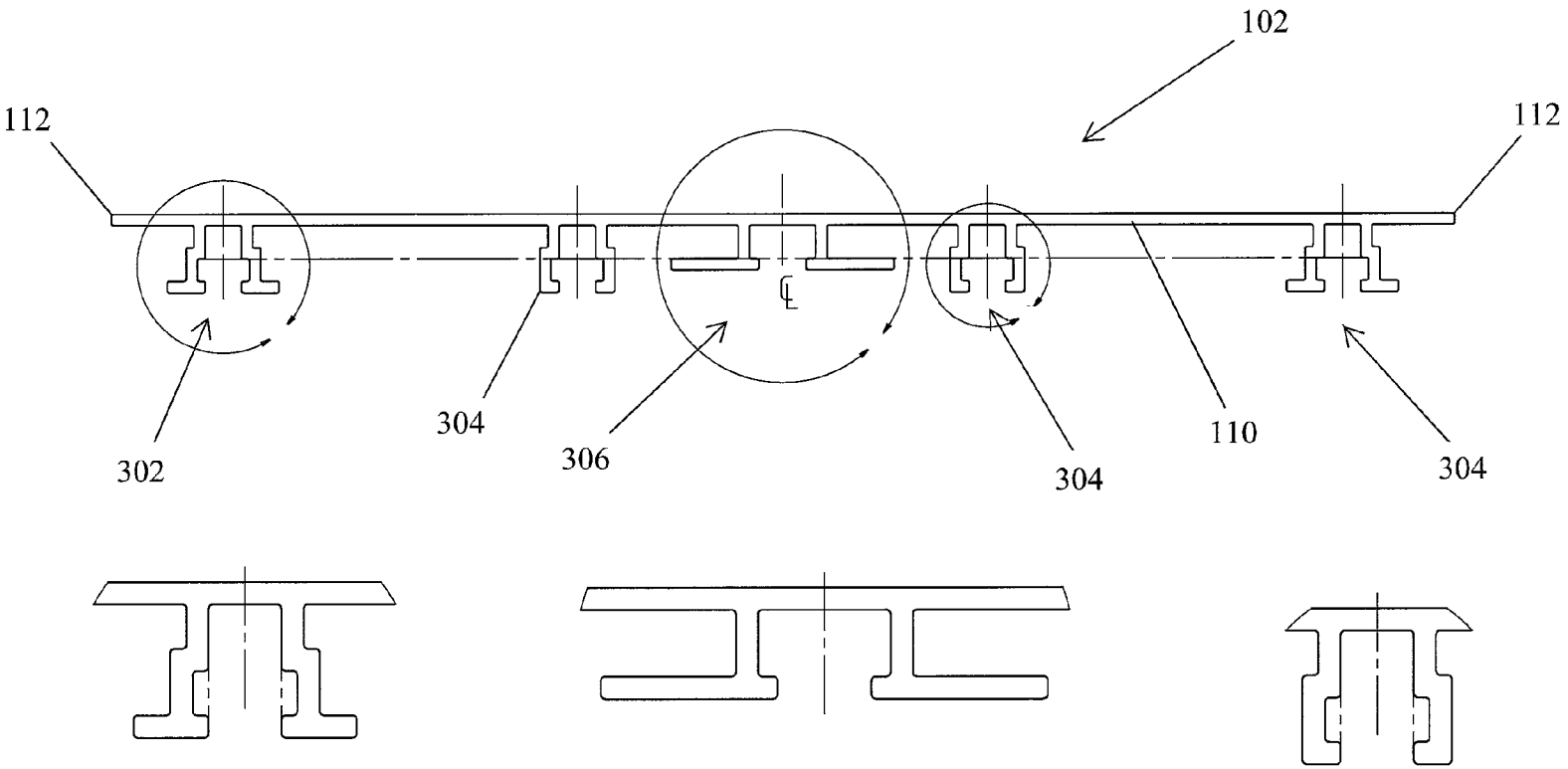
FIG. 8 is a cross-section of the lower work surface of the portable workstation of FIG. 1 taken along section line A-A of FIG. 6 and illustrates exterior channel members, the interior channel members and the center channel member on the underside of the lower work surface.

FIG. 8 is a cross-section of the lower work surface of the portable workstation taken along section line A-A of FIG. 6. As illustrated the external, interior, and center channels 304, 304, 306 may be integrally formed with and extending downward from the undersides 110, 114 of the lower and upper work surfaces 102, 104, respectively. In other implementations, the external, interior, and center channels 302, 304, 306 may be attached to the undersides 110, 114 of the lower and upper work surfaces 102, 104 by fasteners, adhesives, weldments, slot engagement, or any other suitable means. In addition, the external, interior, and center channels 302, 304, 306 may generally be constructed of the same material as the lower and upper work surfaces 102, 104, for example aluminum alloy. In other implementations, the external, interior, and center channels 302, 304 and 306 may be made of a material different from the material of the lower and upper work surfaces 102, 104.

Figure 9:
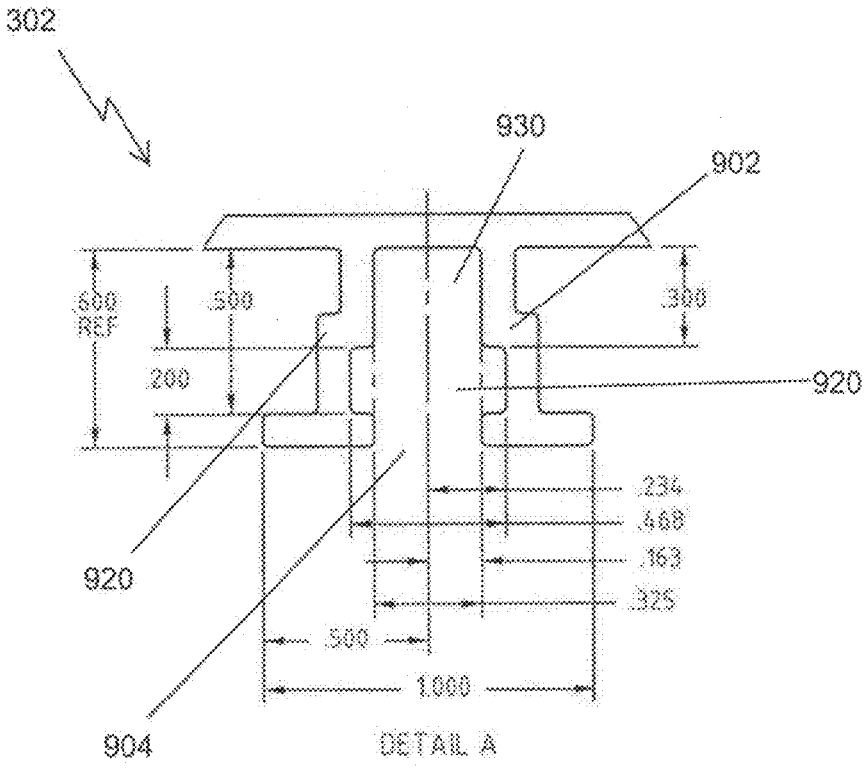
FIG. 9 is an enlarged view of a cross-section of the exterior channel member shown in the encircled area A of FIG. 8.

FIG. 9 is an enlarged view of a cross-section of the external channel 302 shown in the encircled area A of FIG. 8. As illustrated, the external channels 302 include a channel member 902 having a first passage 920, a second passage 930, and an open end 904. The first and second passages 920, 930 are generally rectangular where the width of the first passage 920 is generally larger than the width of the second passage 930. The first passage 902 is configured with dimensions suitable for receiving and slidably retaining a corresponding nut fastener 506 within the passage. The second passage is generally configured with dimensions suitable for receiving a corresponding threaded fastener 508 such that at least a portion of the threaded fastener is slidable within the second passage 930.

Figure 10:
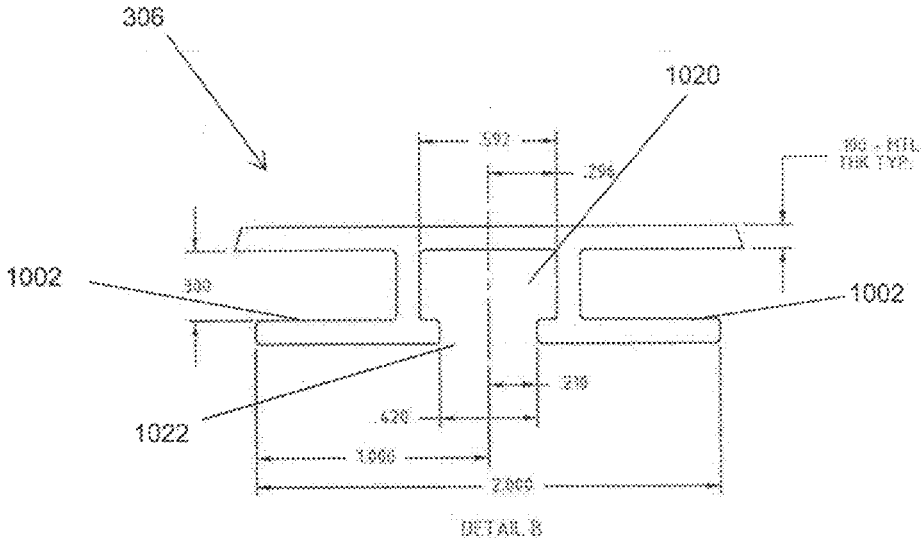
FIG. 10 is an enlarged view of a cross-section of the center channel member shown in the encircled area B of FIG. 8.

FIG. 10 is an enlarged view of a cross-section of the center channel 306 shown in the encircled area B of FIG. 8. As shown, the center channel 306 includes a slot 1020 with a partially closed end 1022 and a pair of elongated seats 1002 extending away from the slot 1020 in parallel spaced-apart relation with the undersides 110, 114 of the work surfaces 102, 104. The slot 1020 is generally configured with dimensions suitable for receiving the T-nut fastener 510 of the upper support fastening members 318 such that the nut fastener is slidable within the slot 1020.

Figure 11:
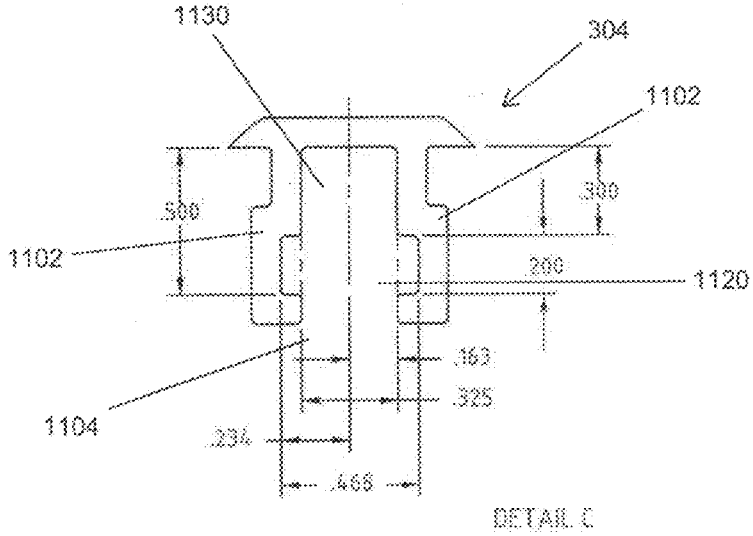
FIG. 11 is an enlarged view of a cross-section of the interior channel member shown in the encircled area C of FIG. 8.
Figures 23, 24:
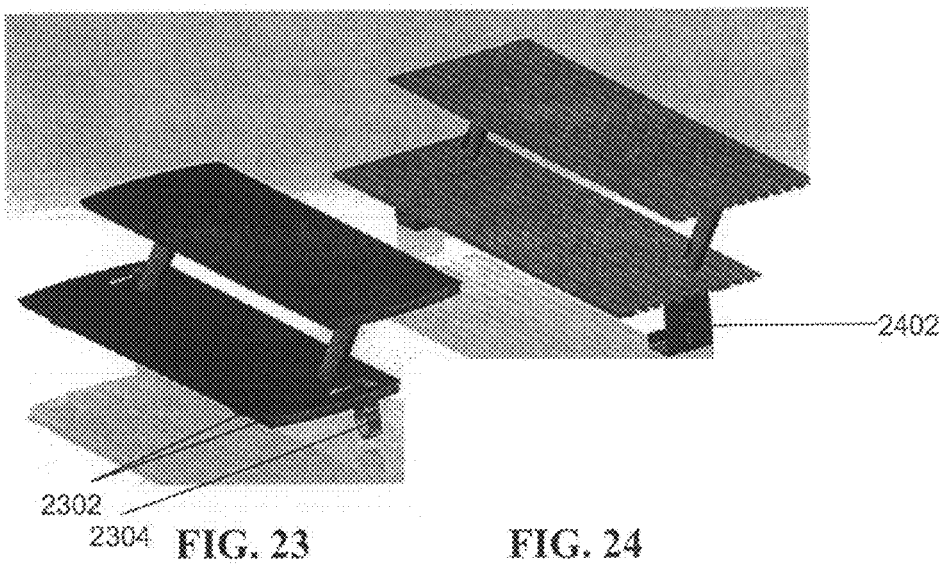
FIG. 23 is a front perspective view of an alternative example of a workstation of the present invention illustrating the lower work surface having slots for threading the fastening members through the slots for securing the workstation to the stabilizing bars of the exercise machine.
FIG. 24 is front perspective view of an alternative example of workstation of the present invention that includes adjustable brackets for securing the workstation to the stabilizing bars of the exercise machine.

FIG. 11 is an enlarged view of a cross-section of the interior channels 304 shown in the encircled area C of FIG. 8. This figure shows that the interior channels 304 generally include a channel member 1102 having a first passage 1120, a second passage 1130, and an open end 1104. Similar to the structure of the external channels, the first and second passages 1120, 1130 are generally rectangular where the width of the first passage 1120 is generally larger than the width of the second passage 1130. The first passage 1120 is configured with dimensions suitable for receiving and slidably retaining a corresponding nut fastener within the passage. The second passage 1130 is generally configured with dimensions suitable for receiving a corresponding threaded fastener such that at least a portion of the threaded fastener is slidable within the passage. In the illustrated example, the interior channels 304 are provided primarily for added stability; however, in other embodiments, the interior channels may be utilized to attach fastening members 108 to the underside 110 of the lower work surface 102, as illustrated in FIG. 24, for example.

Figure 12:
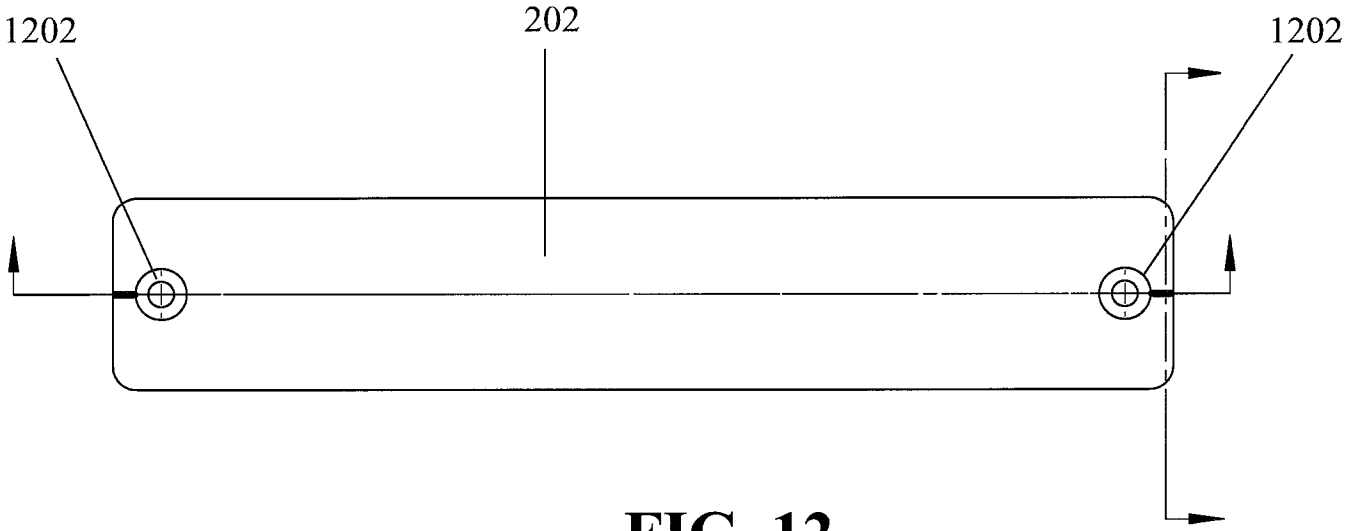
FIG. 12 is a bottom view of an adjustment plate of the portable workstation of FIG. 1.
Figure 13:
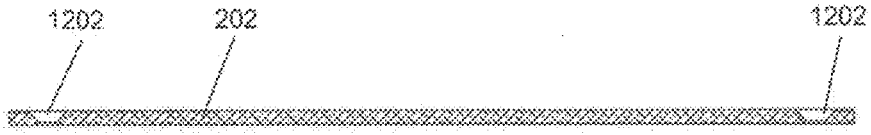
FIG. 13 is a cross-section view of the adjustment plate taken along section line A-A of FIG. 12, the view illustrating the counter-sunk holes on the underside of the adjustment plate.

FIG. 12 is a bottom view of an adjustment plate 202 of the portable workstation 100 and FIG. 13 is a cross-section view of the adjustment plate taken along line A-A of FIG. 12. As shown in these figures, the adjustment plate 202 is a generally elongated rectangular member having at least one countersunk screw hole 1202 formed near each end of the plate. The screw holes 1202 are configured to receive the head a corresponding set of threaded fasteners 508 (see FIG. 5).

Figure 14:
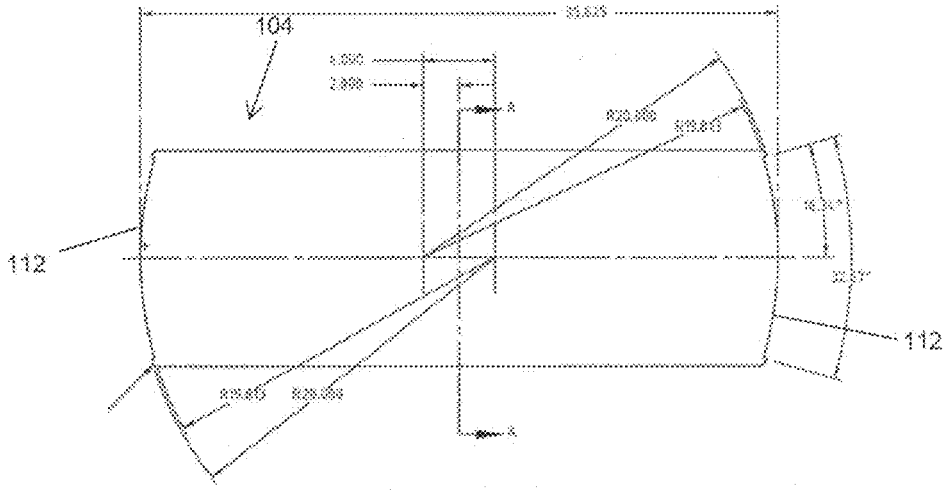
FIG. 14 is a plan view of the upper work surface of the portable workstation of FIG. 1.

FIG. 14 is a plan view of the upper work surface 104 of the portable workstation 100. As shown, the upper work surface 104 may be a planar generally rectangular member having a top "working" surface, an underside 114, and opposing side ends 112. In this example, the upper work surface 104 may have dimensions corresponding to the dimensions of the lower work surface 102, for example, 12 inches wide by 36 inches long. In other implementations, the upper work surface 104 may have different dimensions and shape from the lower work surface 102. For example, the lower work surface 102 may be a rectangular member while the upper work surface 104 may be an arcuate member, a spline-shaped member, or may comprise any other suitable shape or dimensions.

Figure 15:
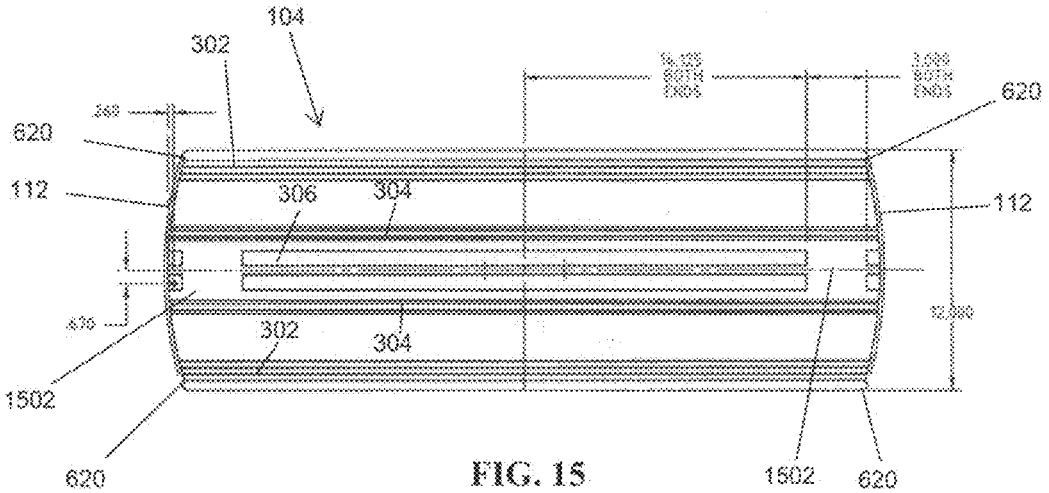
FIG. 15 is a bottom view of the upper work surface of FIG. 14.

FIG. 15 is a bottom view of the upper work surface of the portable workstation. As shown, similar to the underside 110 of the lower work surface 102, the external and interior channels 302, 304 formed on the underside 114 of the upper work surface 104 are generally spaced-apart parallel channels extending substantially along the entire length of the work surface. However, the center channel 306 includes a break 1502 near each end 112 of the work surface to provide the T-nut fasteners 510 (FIG. 5) access to the slot 1020 (FIG. 10).

Figure 16:
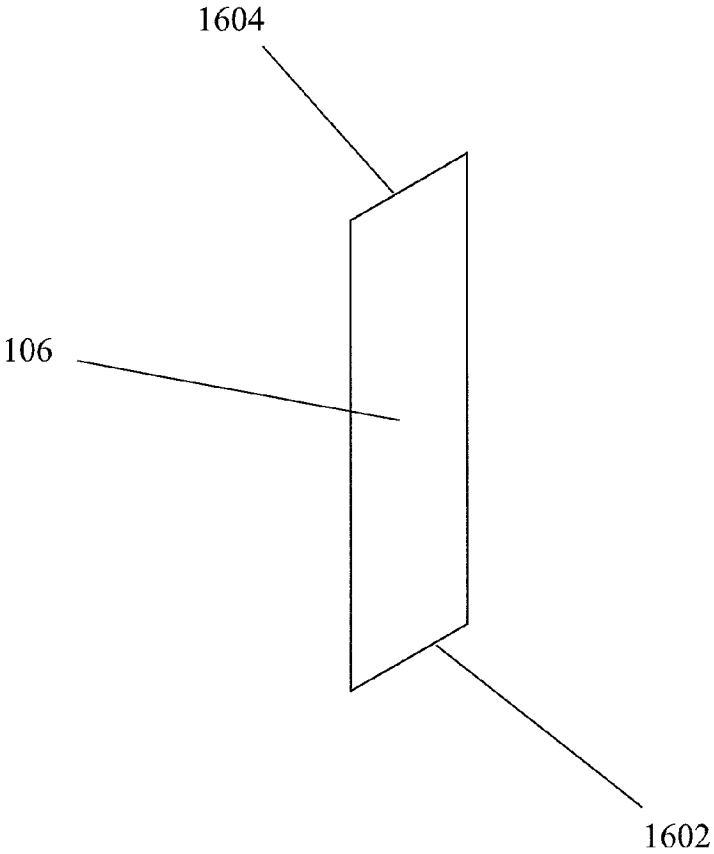
FIG. 16 is a side view of one support member of the portable workstation of FIG. 1.

FIG. 16 is a side view of one support member of the portable workstation. In the illustrated example, the support members 106 are hollow bodied annular members having a distal end 1604 and a proximal end 1602. According to the present example, the support members may have an outer diameter of approximately 1.7 inches, an inner diameter of approximately 1.4 inches, and the ends 1602, 1604 may be tapered at an angle of approximately 60° relative to the body centerline. While the support members of the present example are described as annular members, it will be appreciated by those skilled in the art that the support members may be constructed of any suitable cross-section, for example a square cross-section, and the ends 1602, 1604 may be tapered to any suitable angle.

Figure 17:
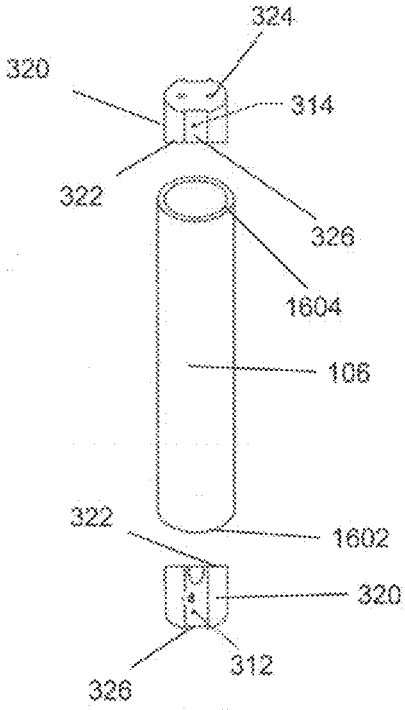
FIG. 17 in an exploded view of the support member of FIG. 16 showing the lower and upper plugs utilized to secure the support member to the lower and upper work surfaces of the workstation.

FIG. 17 in an exploded view of the support member 106 of the portable workstation showing the lower and upper fastening plugs 312, 314 utilized to secure the support members 106 to the lower and upper work surfaces 102, 104 of the workstation 100.

Figure 18:
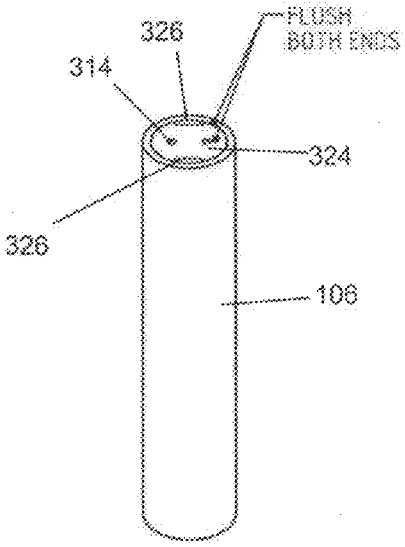
FIG. 18 is a top perspective view of the support member of FIG. 16 showing a plug positioned in the upper end of the support member for securing the support member to the lower side of the upper work surface.

FIG. 18 is a top perspective view the support member 106 showing the upper fastening plug 314 positioned in an upper end of the support member 106 for securing the support member to the underside 114 of the upper work surface 104.

Figure 19:
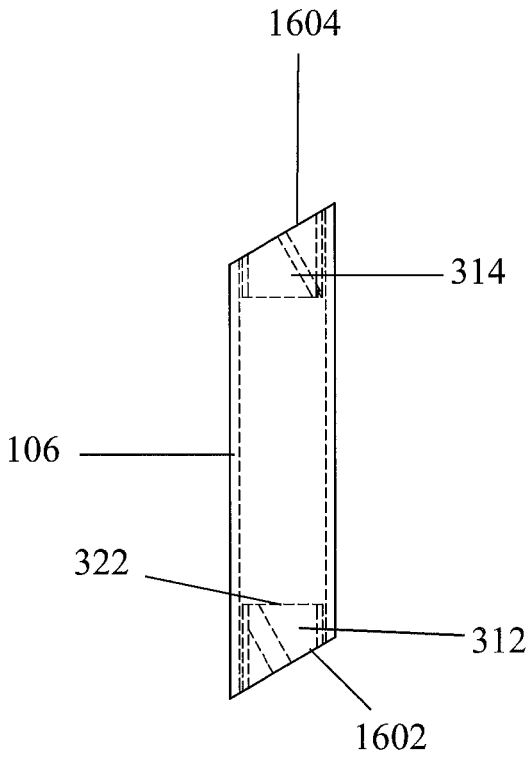
FIG. 19 is a cross-section view of the support member of FIG. 16 showing the positioning of the lower and upper plugs in the hollow body of support member at the lower and upper ends of the support member.

FIG. 19 is a cross-section view of the support member 106 showing the positioning of the lower and upper fastening plugs 312, 314 in the hollow-body of the support member at the proximal and distal ends 1602, 1604 of the support member, respectively.

As shown from the above FIGS. 17-19, the lower and upper fastening plugs 312, 314 may be configured to engage and enclose a lower and upper portion of the support members 106. As previously discussed, the support members 106 are coupled between the lower and upper work surfaces 102, 104 by the lower and upper fastening plugs 312, 314. The lower and upper fastening plugs 312, 314 may be made of the same material and have the same cross-section of the support members 106, or may be made of any other compatible construction or material.

As illustrated, the lower and upper fastening plugs 312, 314 may include generally a cylindrical body 320 (FIG. 17) having a planar surface 322 and a tapered surface 324. The outer dimensions of the body 320 of the fastening plugs correspond to the inner diametrical dimensions of its corresponding support member 106 to provide a snug or interference fit between the fastening plug and the inner wall of the support member 106. Likewise, the tapered surfaces 324 of the fastening plugs may tapered to the same angular dimensions as the tapered ends 1602, 1604 of the support members 106 to provide a flush surface interface between tapered plug surface 324 and annular surface of the tapered ends 1602, 1604 when the lower and upper fastening plugs 312, 314 are mated with the lower and upper portions of the support members 106, as shown in FIGS. 18 and 19.

As best shown in FIGS. 17 and 18, the fastening plugs 312, 314 also include a pair of diametrically opposed weldment voids 326 and one or more threaded holes extending from the tapered surface 324 to the planar surface 322. The weldment voids 326 extend along the length of the circular body 320, parallel to the body centerline.

In addition, the threaded holes of the fastening plugs 312, 314 may have dimensions corresponding with the dimensions of the thru holes 520 of the lower work surface 102 and the partially closed end 1022 of the center channel 306, respectively, to accommodate threaded fasteners 502, 512 (FIG. 5) securing the lower and upper fastening plugs 312, 314 to the lower and upper work surfaces 102, 104.

While the examples herein describes the use of fastening plugs 312, 314 to secure the support members to the lower and upper work surfaces, it will be appreciated by persons skilled in the art that the support members may be directly secured to the lower and upper work surfaces by mechanical fasteners, welding, bonding, or any other suitable means.

Turning back to the support members 106, prior to assembly, as shown in FIG. 18, the lower and upper fastening plugs 312, 314 may be installed and secured to respective lower and upper portions of the support member 106. Once the fastening plugs 312, 314 are installed at the ends 1602, 1604 of support members 106, such that the tapered surfaces 324 are flush with the annular surface along the support member ends 1602, 1604, the tapered surfaces 324 may be welded, for example by a TIG or spot weld, to the support members 106 at the weldment voids 326. In other implementations the lower and upper fastening plugs 312, 314 may be secured to the ends 1602, 1604 of the support members 106 by press or interference fit, fasteners, industrial adhesive, a key, or any other suitable means.

Figure 20:
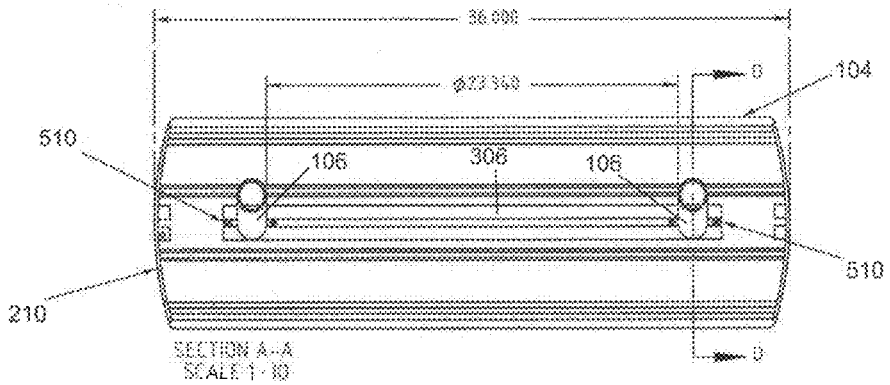
FIG. 20 is a bottom view of the upper work surface of FIG. 14 showing the engagement of the support members to the underside of the upper work surface.

FIG. 20 is a bottom view of the upper work surface 104 showing the engagement of the support members 106 to the underside 114 of the upper work surface. As partially illustrated by this figure, the workstation 100 of the present invention may be assembled and installed on exercise equipment in a series of steps. First, the support members 106 may be assembled by securing the fastening plugs 312, 314 to the proximal and distal ends 1602, 1604 of the support member 106. Once the fastening plug members 312, 314 are installed, the T-nuts 510 may be fastened to distal end 1604 of the support members 106 and the T-nuts 510 may be slid into opposite ends of the center channel 306 via the break 1502. After the T-nut 510 assemblies are installed in the center channel, the relative distance between the support members 106 may be adjusted to correspond to the relative locations of the lower work surface 102 thru holes 520.

Once adjusted, the lower work surface 102 may be fastened to the lower fastening plug 312 by threaded fasteners 502 at the thru holes 520. Once the lower work surface 102 is secured to support members 106, the adjustment plates 202 may be secured to the underside 110 of the lower work surface 102 by the plate fastening mechanism 310 and adjusted to according the dimensions of the horizontal support bars of the exercise machine. Once the adjustment plates 202 are adjusted and secured to the underside 110 of the lower work surface 102, the protective strips 204 may be adhered to the bottom of the adjustment plates 202 to provide a contact surface between the workstation 100 and the horizontal stabilizing bars of the exercise machine.

After the protective strips 204 are attached to the bottom of the adjustment plates 202, the workstation 100 may be mounted on the horizontal stabilizing bars of the exercise equipment and the fastening members 108 may be secured to the stabilizing bars.

Figure 21:
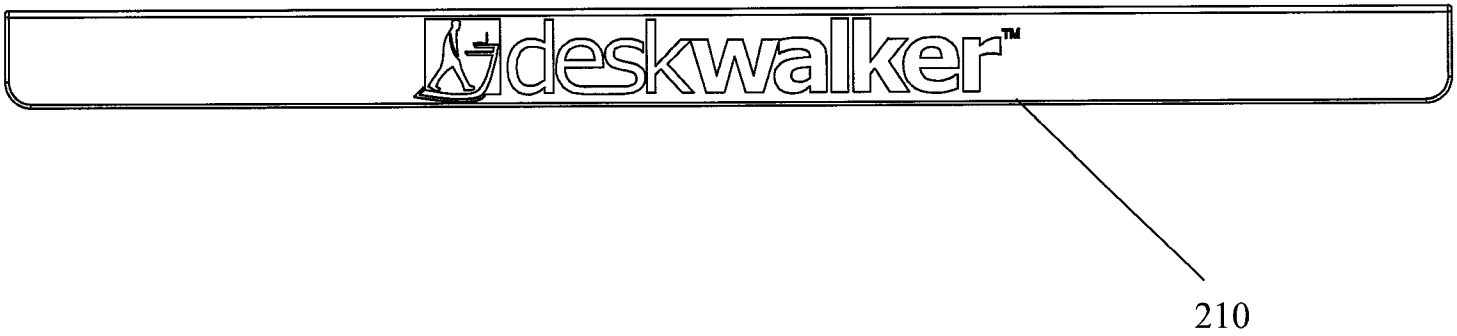
FIG. 21 is one example of an end cap for positioning on the exterior side edges of both the lower and upper work surface of the portable workstation of FIG. 1.

FIG. 21 is one example of a protective end cap 210 that may be secured to the side ends 112, 118 of the lower and upper work surfaces 102, 104. In this example, the end caps 210 are made of plastic. In other implementations, the ends caps 210 may be made of rubber or any other suitable resilient material. The purpose of the end caps 210 is to provide the lower and upper work surfaces 102, 104 with soft smooth edges to minimize cuts and other abrasions that may result when a user contacts the edge of the work surfaces during installation or use.

Figure 22:
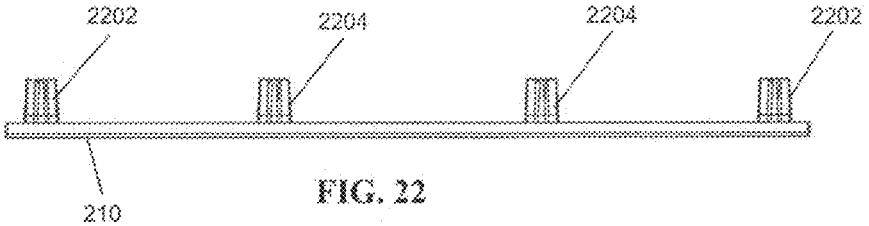
FIG. 22 is a plan view of the end cap of FIG. 21 having a male extension for inserting into corresponding channels on the underside of the lower and upper work surfaces.

As shown in FIG. 22, the protective end cap 210 may generally include an outer set of male extensions 2202 and an inner set of male extensions 2204. The outer male extensions 2202 are configured to insert into the outer edges of the external channels 302 on the underside 110, 114 of the lower and upper work surfaces 102, 104, respectively. The inner male extensions 2204 are configured to insert into the outer edges of the interior channels 304 on the underside 110, 114 of the lower and upper work surfaces 102, 104, respectively.

FIG. 23 is front perspective view of an alternative example of a workstation 100 of the present invention. In this example, the lower work surface 102 may include slots 2302 for threading the fastening members 2304 through the slots to secure the workstation 100 to the stabilizing bars of the exercise machine.

FIG. 24 depicts another alternative example of a workstation 100 of the present invention where the fastening members include adjustable brackets 2402 for securing the workstation to the stabilizing bars of the exercise machine. The adjustable brackets 2402 may include, for example, a pair of C-shaped bracket mounts that are adjustably coupled to opposite ends of the underside 110 of the lower work surface 102. The C-shaped brackets can be fastened to one or more of the external, interior or center channels 302, 304 and 306 on the underside 110 of the lower work surface 102. The brackets 2402 may include engagement screws (not shown) that may be adjusted to engage the stabilizing bars of the exercise equipment in a similar manner as the adjustment plates are engaged in accordance with the example provided in FIGS. 1-22. Accordingly, the mounts 2402 may be adjusted inwardly or outwardly, and/or up or down to accommodate exercise equipment of various dimensions.

In this example, the underside 110 of the lower work surface 102 may include a series of spacers (not shown) attached along its outward edges. For example, in one implementation the spacers may be attached to the underside 110 of the lower work surface at each corner of the surface. The spacers may be configured to rest against between the bracket 2402 and a portion of the exercise equipment to provide a cushion between the lower work surface 102 and the exercise equipment. For example, the spacers may rest against the handrails of a treadmill machine. Thus, the dimensional locations of the spacers may correspond to the standard dimensions of the handrails of modern exercise equipment. According to the invention, the spacers may be made of rubber, plastic, Teflon®, or any other suitable material. In other implementations, the bracket mounts 2402 may include adjustable straps for securing the workstation to the exercise equipment.

Figure 25:
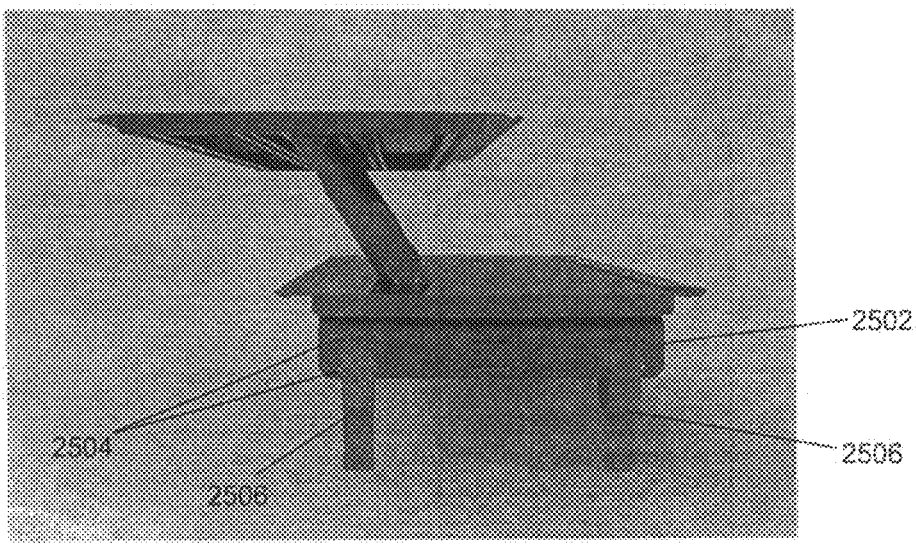
FIG. 25 is a side view of yet another alternative example of a workstation of the present invention that includes adjustable brackets and adjustable fastening members for securing the workstation to the stabilizing bars of an exercise machine.

FIG. 25 illustrates another alternative example of a workstation 100 of the present invention where the fastening members are adjustable brackets 2502 having straps 2506 secured thereto. The lower work surface 102 includes adjustable brackets 2502 and adjustable fastening members 2506 for securing the workstation 100 to the support bars of an exercise machine. In this example, the bracket mounts include slots 2504 for threading straps through the adjustable brackets.

When assembled, as shown in FIGS. 1 and 3, the angled support members 106 maintain the upper work surface 104 in a tiered, spaced apart relationship with the lower work surface 102. The tiered arrangement provides an ergonomic design that gives the user easy access to articles located on the working surfaces, while the user exercises. For example, a user may view a computer monitor supported by the upper work surface 104 while the user types on a keyboard supported by the lower work surface 102. In another example, a user may take notes on a notepad supported by the lower work surface 102 while the user reads a book supported by the upper work surface 104.

In addition to the benefits discussed above, the spaced arrangement between the lower work surface 102 and the upper work surface 104 provides the user with an unobstructed view and access to the control panel of the exercise equipment, and allows communication between compatible devices supported on different working surfaces; such as a computer monitor supported by the upper work surface and a keyboard supported by the lower work surface.

While implementations of the present invention are described herein as being adapted for use with a treadmill exercise machine, persons skilled in the art will appreciate that the portable workstations of the present invention may be used with many different types of exercise equipment having various sizes and structure.

Although not illustrated, those skilled in the art will recognize that a workstation of the present invention may include a collapsible structure that enables the upper work surface to be moved towards or away from the lower work surface by any mechanical means now known. For example, the support members may be pivotally coupled to the lower and upper work surfaces 102, 104. When in operation, the support members may be locked in an upright position, but for storage, the pivotal coupling of the support members may be released to allow the lower and upper work surfaces 102, 104 to collapse into a storage state.

In general, terms such as "coupled to," and "configured for coupling to" and "secured to" (for example, a first component is "coupled to" or "is configured for coupling to" or is "secured to" a second component) are used herein to indicate a structural, functional, mechanical, electrical, signal, optical, magnetic, electromagnetic, ionic or fluidic relationship between two or more components or elements. As such, the fact that one component is said to couple to a second component is not intended to exclude the possibility that additional components may be present between, and/or operatively associated or engaged with, the first and second components.

The foregoing description has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

We claim:

1. A portable workstation for use in connection with an exercise machine having stabilizing bars, the workstation comprising:

a primary work surface having an underside and two opposing side ends; and at least one pair of straps secured to the underside of the primary work surface on opposing sides of the underside of the work surface so that the straps extend downward from the underside of the primary work surface for attachment to the stabilizing bars of the exercise machine, where the at least one pair of straps has an upper end and where the underside of the primary work surface includes at least one channel extending lengthwise along the primary work surface, where the channel is design for receiving fasteners along the length of the channel for securing the upper end of the at least one pair of straps to the at least one channel at various positions along the length of the primary work surface.

2. The portable workstation of claim 1 where the relative distance between the pair of straps may be adjusted to accommodate exercise equipment of various dimensions.

3. The portable workstation of claim 1 where the straps are adjustable Velcro straps.

4. The portable workstation of claim 1 further comprising:

an upper work surface coupled to the primary work surface; and at least one support member, where the support member is secured to the underside of the upper work surface and the top side of the primary work surface and where the at least one support member maintains a tiered, spaced apart relationship between the upper and primary work surfaces.

5. A portable workstation for use in connection with an exercise machine having stabilizing bars, the workstation comprising:

a lower work surface having an underside, where the underside of the lower work surface further including at least one channel extending along the length of the underside;

an upper work surface coupled to the lower work surface;

at least one support member, where the support member is secured to the underside of the upper work surface and the top side of the lower work surface and maintains a tiered, spaced apart relationship between the upper and lower works surfaces; and two opposing adjustment plates slidably fastened to the channel such that the relative distance between opposing fastening members may be adjusted to accommodate exercise equipment of various dimensions;

at least two opposing fastening members coupled to the lower work surface for attachment to the stabilizing bars of the exercise machine, where the at least two opposing fastening members are positioned on opposing sides of the lower work surface and where each fastening member has an upper and lower end and an opening for receiving the stabilizing bars of the exercise machine;

where the upper end of each fastening member is coupled to one of the two opposing adjustment plates for securing the fastening members at various positions along the length of the lower work surface, whereby the relative distance between opposing fastening members may be adjusted; and where each fastening member includes a tightening mechanism for reducing the size of the opening of the fastening member for securing the fastening member to the stabilizing bar of the exercise machine.

* * * * *